US007001194B2

(12) United States Patent
Yang et al.

(10) Patent No.: US 7,001,194 B2
(45) Date of Patent: Feb. 21, 2006

(54) ELECTRIC POWER CONNECTOR AND ELECTRIC POWER CONNECTOR ASSEMBLY

(75) Inventors: Yung-Hung Yang, Tainan Hsien (TW); Chien-Hua Chiao, Tainan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/875,416

(22) Filed: Jun. 24, 2004

(65) Prior Publication Data

US 2005/0014409 A1 Jan. 20, 2005

(30) Foreign Application Priority Data

Jul. 18, 2003 (TW) ..... 92119753 A

(51) Int. Cl.
*H01R 25/00* (2006.01)

(52) U.S. Cl. ..... 439/295; 439/345

(58) Field of Classification Search ..... 439/290, 439/291, 295, 284, 345, 358
See application file for complete search history.

(56) References Cited

U.S. PATENT DOCUMENTS

| | | | | |
|---|---|---|---|---|
| 3,259,870 | A * | 7/1966 | Winkler | 439/295 |
| 3,676,833 | A * | 7/1972 | Johnson | 439/295 |
| 4,083,617 | A * | 4/1978 | Wyatt | 439/295 |
| 4,335,931 | A * | 6/1982 | Kinnear | 439/295 |

* cited by examiner

*Primary Examiner*—Hien Vu
(74) *Attorney, Agent, or Firm*—Madson & Metcalf

(57) ABSTRACT

A connector is provided. The connector comprises a casing having an open end defined by a first cavity and a second cavity adjacent to the first cavity, wherein a cross-section area of the first cavity is bigger than that of the second cavity, a first retaining plate and a second retaining plate disposed in the casing and having a specific distance away from the open end, wherein the first retaining plate and the second retaining plate cooperate with each other to form an opening and a receiving space, and the first retaining plate and the second retaining plate respectively form a gap with the inner sidewall of the casing, and a conductive terminal with one end disposed in the receiving space formed by the first retaining plate and the second retaining plate. In addition, a connector assembly, which is assembled with the above-mentioned connectors, is also provided.

15 Claims, 15 Drawing Sheets

ELECTRIC POWER CONNECTOR AND ELECTRIC POWER CONNECTOR ASSEMBLY

FIELD OF THE INVENTION

The present invention relates to a connector, and more particularly to a connector which surely conforms to the safety requirement and can be connected conveniently, rapidly and firmly. The present invention further relates to a connector assembly which can be assembled easily and applied to various aspects.

BACKGROUND OF THE INVENTION

Various connectors have been broadly applied to deliver electric power from power-supplying devices to power-receiving devices. Please refer to FIG. 1, in which an uninterrupted power supply system is taken as an example and comprises an input 10, a printed circuit board 11, a battery 12 and an output 13. When the utility power is normally provided, the electronic circuit on the printed circuit board 11 converts the utility power from alternating current (AC) to direct current (DC) for being used by the power-receiving device and charging the battery 12. When the utility power is unavailable, the uninterrupted power supply system converts the electric power stored in the battery 12 from direct current (DC) to alternating current (AC) so as to continuously supply power to the power-receiving device and avoid power failure.

In order to accomplish the above-mentioned objects, the battery 12 needs to be electrically connected with the printed circuit board 11. Generally, the battery 12 of the uninterrupted power supply system 1 is electrically connected with the printed circuit board 11 by electric wires and connectors. Please refer to FIGS. 2(*a*) and (*b*), which illustrate the printed circuit board and the battery are electrically connected via two electric wires and two connectors, wherein the electric wire of one connector is connected with the battery, and the electric wire of the other connector is connected with the printed circuit board. As shown in FIGS. 2(*a*) and (*b*), the sizes of the two connectors are identical, and the casings 21 of the two connectors are substantially rectangular solids. Each connector 2 carries a resilient piece 23 inside the casing 21. One end 231 of the resilient piece 23 is fixed to the inner sidewall of the casing 21, and the other end 232 of the resilient piece 23 is contacted with one end 241 of a conductive terminal 24. Additionally, the other end 242 of the conductive terminal 24 is connected with the electric wire 27, and the electric wires 27 are respectively connected with the printed circuit board (not shown) and the battery (not shown). Besides, the open end 25 of each connector 2 is defined by a clipping piece 26 and an extended sidewall 28 of the casing 21.

Please refer to FIGS. 2(*a*) and (*b*) again; the two connectors 2 are electrically connected by inserting the clipping piece 26 of one connector 2 into the open end 25 of the other connector 2. Therefore, the conductive terminals of the two connectors can be contacted tightly with each other by the restoring force of the resilient pieces 23, and the two connectors are engaged with each other via the coordinating clipping pieces 26 and extended sidewalls 28 of the casings 21.

However, the above-mentioned connector has the following drawbacks: (1) The distance between the conductive terminal 24 and the outside environment is quite short; however, such design can reluctantly pass the test of test finger and conform to the electrical safety requirement but there still exists danger. (2) The distance between the conductive terminal 24 and the open end 25 is quite short. When the two connectors are not engaged with each other perfectly, a gap will be created between the extended sidewall 28 and the clipping piece 26. Because the creepage distance is short, current leakage or short might be caused as the connectors are used in a humid condition. (3) After assembling and disassembling the connectors for many times, the clipping piece 26 is easily broken or the tolerance might be lost, which results in that the two connectors cannot be engaged with each other.

In addition, the electrical conductance between the printed circuit board 11 and the battery 12 is not just dependent on one electric wire 27 and one connector 2. The anode and the cathode of the battery 12 need to employ two electric wires 27 and two connectors 2 to electrically connect with two corresponding electric wires 27 and two connectors 2 from the printed circuit board 11. Because the design of the conventional connectors cannot allow the two connectors of the battery 12 (or the printed circuit board 11) to be assembled to form a connector assembly in advance and then be connected with the connector assembly of the printed circuit board 11 (or the battery 12), the printed circuit board 11 and the battery 12 cannot be electrically connected efficiently and firmly. Besides, when the printed circuit board 11 is electrically connected with the battery 12 according to the conventional method, the electric wires 27 and the connectors 2 will disperse in the uninterrupted power supply system 1. Hence, the conventional method leads to inefficient usage of the inner space and complex dissembling processes.

Therefore, to overcome the disadvantages of the prior art, it is needed to develop a connector which surely conforms to the safety requirement and can be connected conveniently, rapidly and firmly, and to develop a connector assembly which can be assembled easily and applied to various aspects.

BRIEF SUMMARY OF THE INVENTION

The main object of the present invention is to provide a connector which surely conforms to the safety requirement and can be connected conveniently, rapidly and firmly.

Another object of the present invention is to provide a general connector, which can be connected directly with another one to deliver the electric power between an electrical equipment and a power supply.

Another object of the present invention is to provide a connector assembly which can be assembled easily and applied to various aspects.

In accordance with an aspect of the present invention, a connector is provided. The connector comprises a casing having an open end defined by a first cavity and a second cavity adjacent to the first cavity, wherein a cross-section area of the first cavity is bigger than that of the second cavity, a first retaining plate and a second retaining plate disposed in the casing and having a specific distance away from the open end, wherein the first retaining plate and the second retaining plate cooperate with each other to form an opening and a receiving space, and the first retaining plate and the second retaining plate respectively form a gap with the inner sidewall of the casing, and a conductive terminal with one end disposed in the receiving space formed by the first retaining plate and the second retaining plate.

In an embodiment, the casing carries a resilient piece therein, and one end of the resilient piece is fixed to or propped up the inner sidewall of the casing and the other end of the resilient piece is contacted with one end of the conductive terminal. The other end of the conductive terminal is connected with an electric wire.

In an embodiment, the casing further comprises at least a protruding pillar vertically arranged on one sidewall of the casing, and at least a guide slot vertically arranged on the opposite sidewall of the casing and corresponding to the protruding pillar.

In an embodiment, the casing further comprises two positioning elements respectively disposed on two opposite sidewalls of the casing. For example, the two positioning elements are a protrusion and a concave respectively.

In an embodiment, the casing is substantially a rectangular solid and has a wire-exiting end. Additionally, a cross-section of the casing is substantially ⊔-shaped.

In accordance with another aspect of the present invention, a connection structure of connectors is provided. The connection structure of connectors comprises at least two connectors having identical size and shape. Each connector comprises a casing having an open end defined by a first cavity and a second cavity adjacent to the first cavity, wherein a cross-section area of the first cavity is bigger than that of the second cavity, a first retaining plate and a second retaining plate disposed in the casing and having a specific distance away from the open end, wherein the first retaining plate and the second retaining plate cooperate with each other to form an opening and a receiving space, and the first retaining plate and the second retaining plate respectively form a gap with the inner sidewall of the casing, and a conductive terminal with one end disposed in the receiving space formed by the first retaining plate and the second retaining plate. Thereby, the two connectors are connected with each other by inserting the second cavity of each connector into the first cavity of the other connector to make the conductive terminals in the casings of the two connectors contact with each other.

In an embodiment, the casing carries a resilient piece therein, and one end of the resilient piece is fixed to or propped up the inner sidewall of the casing and the other end of the resilient piece is contacted with one end of the conductive terminal. The other end of the conductive terminal is connected with an electric wire.

In accordance with an additional aspect of the present invention, a connector assembly is provided. The connector assembly comprises a plurality of connectors. Each connector comprises a casing having an open end, a conductive terminal disposed in the casing, at least a protruding pillar vertically arranged on one sidewall of the casing, and at least a guide slot vertically arranged on the opposite sidewall of the casing and corresponding to the protruding pillar. Thereby, the plurality of connectors are assembled into a connector assembly by up and down engagement via the protruding pillar on one connector and the guide slot on another connector.

In an embodiment, the open end is defined by a first cavity and a second cavity adjacent to the first cavity, and a cross-section area of the first cavity is bigger than that of the second cavity.

In an embodiment, the casing further comprises a first retaining plate and a second retaining plate having a specific distance away from the open end. The first retaining plate and the second retaining plate cooperate with each other to form an opening and a receiving space, and the first retaining plate and the second retaining plate respectively form a gap with the inner sidewall of the casing.

In an embodiment, the casing further comprises two positioning elements respectively disposed on two opposite sidewalls of the casing. For example, the two positioning elements are a protrusion and a concave respectively.

In an embodiment, the casing carries a resilient piece therein, and one end of the resilient piece is fixed to or propped up the inner sidewall of the casing and the other end of the resilient piece is contacted with one end of the conductive terminal. The other end of the conductive terminal is connected with an electric wire.

In an embodiment, the casing is substantially a rectangular solid and has a wire-exiting end.

Now the foregoing and other features and advantages of the present invention will be best understood through the following descriptions with reference to the accompanying drawings, wherein:

DETAILED DESCRIPTION OF THE PREFERRED EMBODIMENT

Figure 1:
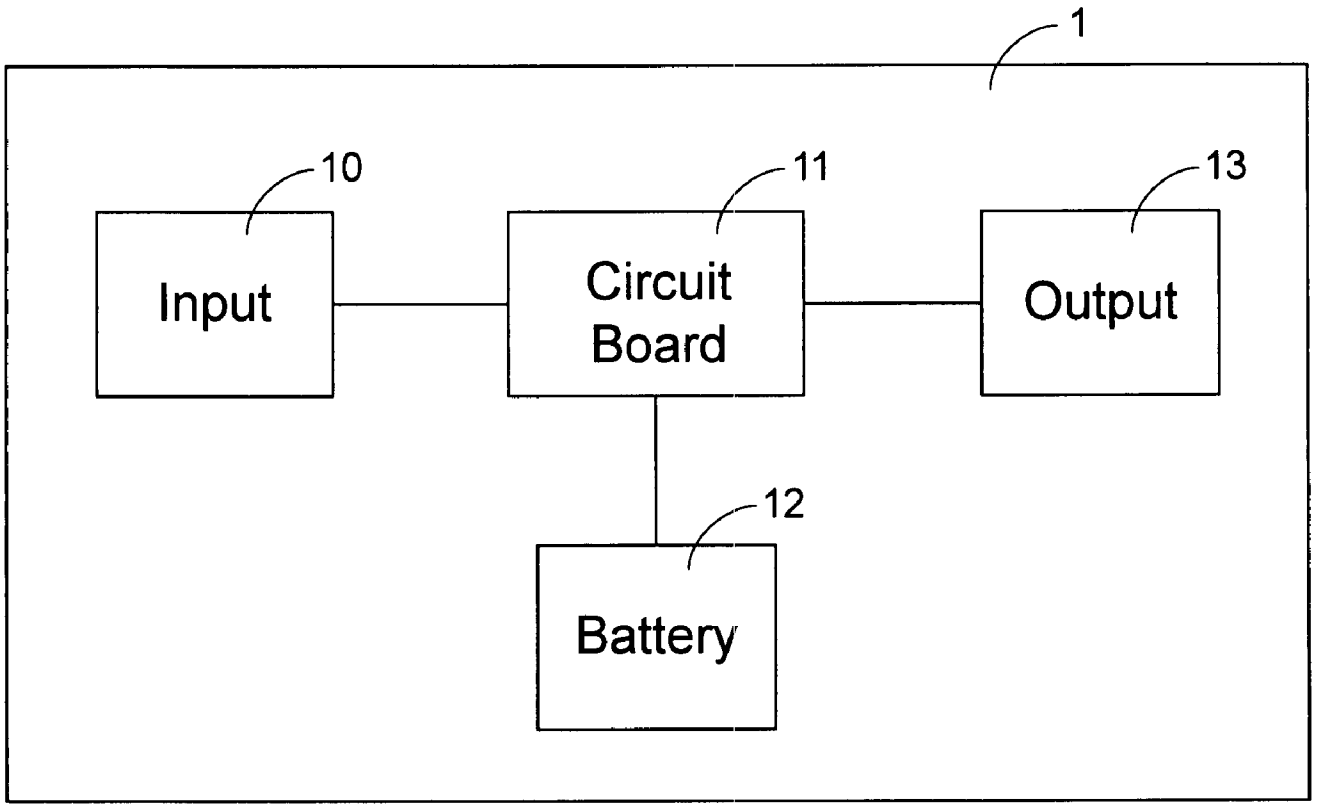
Fig. 1 (Prior Art)
FIG. 1 shows a framework of an uninterrupted power supply system.
Figure 2A:
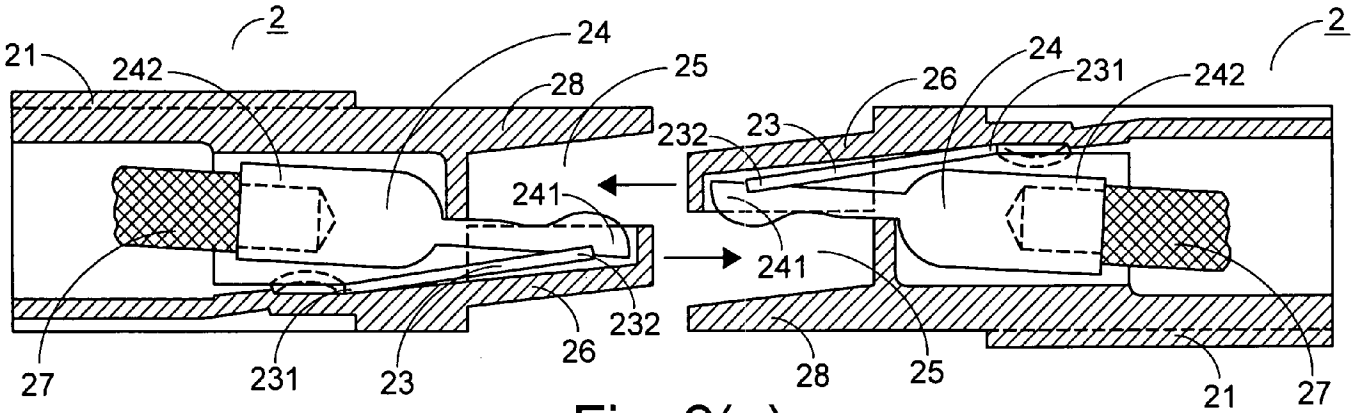
Fig. 2(a) (Prior Art)
FIGS. 2(*a*) and (*b*) illustrate the printed circuit board and the battery are electrically connected via two electric wires and two connectors according to the prior art.
Figure 2B:
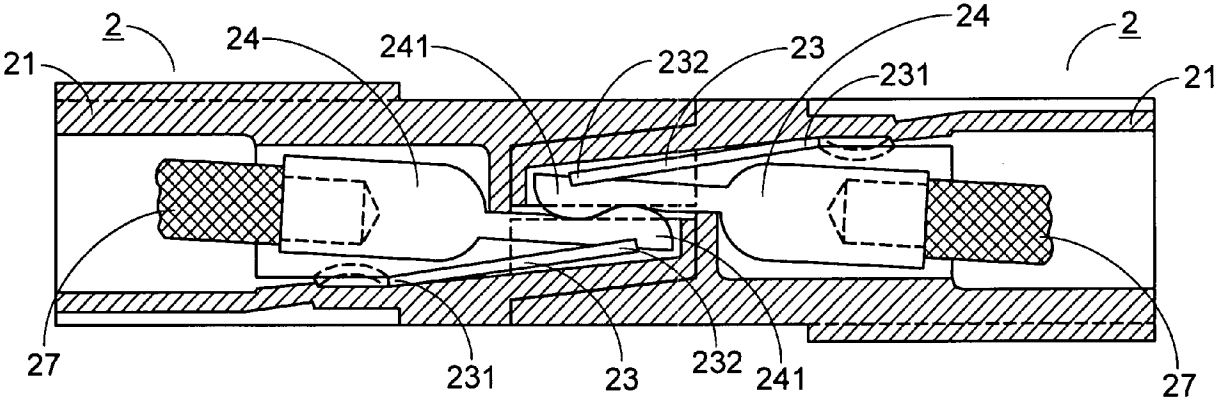
Fig. 2(b) (Prior Art)
Figure 3:
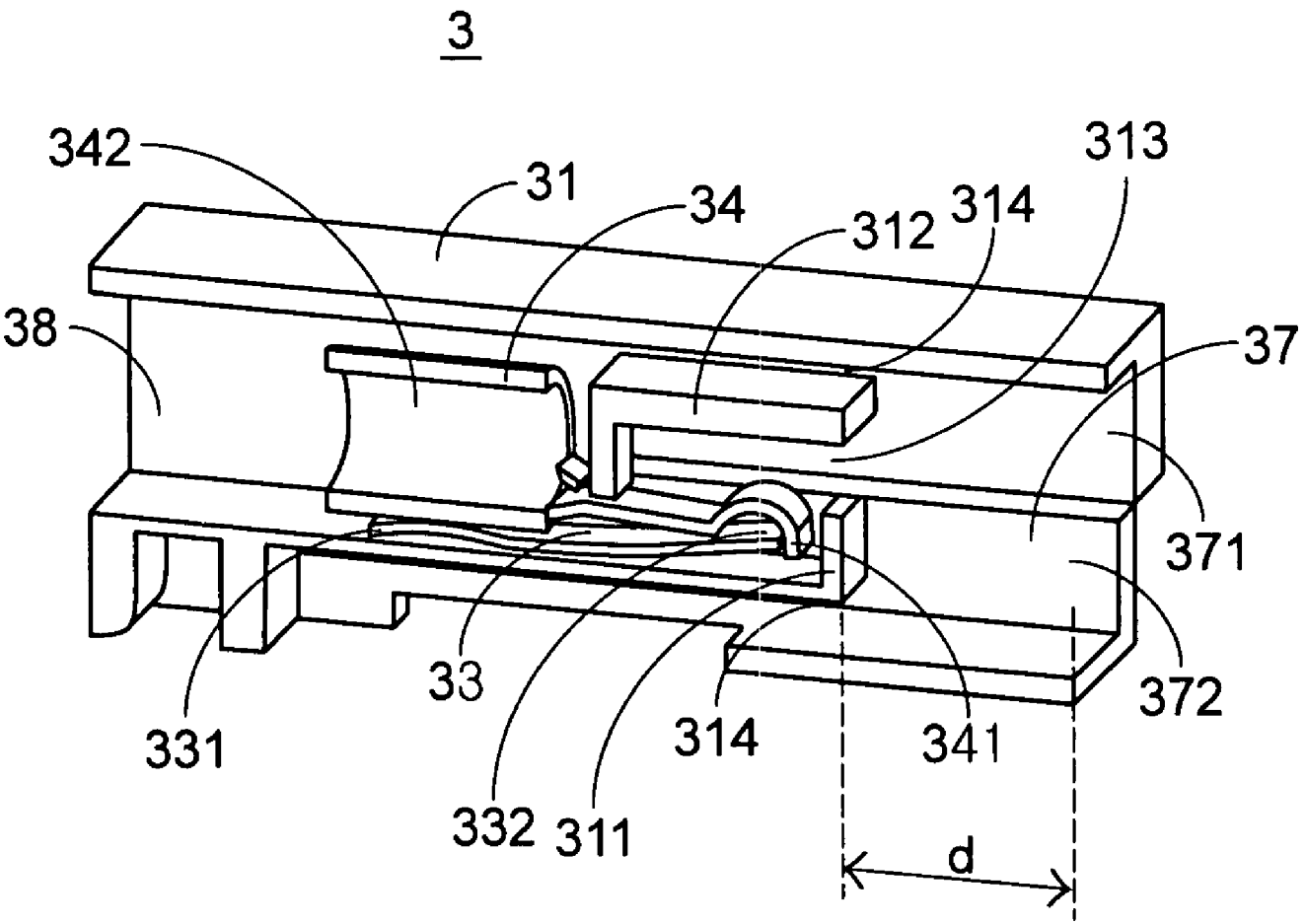
FIG. 3 shows a cross-sectional view of the connector according to a preferred embodiment of the present invention.

Please refer to FIG. 3, which shows a cross-sectional view of the connector according to a preferred embodiment of the present invention. As shown in FIG. 3, the connector of the present invention comprises a casing 31 and a conductive terminal 34, wherein the casing 31 of the connector 3 is substantially a rectangular solid and comprises an open end 37 and a wire-exiting end 38. The casing 31 is defined by a first cavity 371 and a second cavity 372 adjacent to the first cavity 371, and the cross-section of the casing 31 is substantially ⊔-shaped. Certainly, in this embodiment, the cross-section area of the first cavity 371 is preferably bigger than that of the second cavity 372. Additionally, the casing 31 further comprises a first retaining piece 311 and a second retaining piece 312 which are respectively disposed inside the second cavity 372 and the first cavity 371 of the casing 31 and are away from the open end 37 a specific distance d. In this embodiment, the specific distance d is longer than the distance required by the electrical safety requirement. Besides, the first retaining piece 311 and the second retaining piece 312 can cooperate with each other to form an opening 313 which can allow the conductive terminal (not shown) of another connector to enter and contact with the conductive terminal 34 therein. Certainly, one end 341 of the conductive terminal 34 can be disposed in the space formed by the first retaining piece 311 and the second retaining piece 312. Moreover, a gap 314 exists between the sidewall of the casing 31 and the first retaining piece 311, and the second retaining piece 312 as well. When two connectors 3 are connected, the sidewall of the casing 31 of one connector can be inserted into the gap 314 of the other connector and contacted with the retaining piece, so as to increase the contact area and make the connection therebetween firmer.

Please refer to FIG. 3 again; the connector 3 further includes a resilient plate 33. One end 331 of the resilient plate 33 is fixed to or propped up the inner sidewall of the casing 31, and the other end 332 of the resilient piece 33 is contacted with one end 341 of the conductive terminal 34 and disposed in the space formed by the first retaining piece 311 and the second retaining plate 312. Additionally, the other end 342 of the conductive terminal 34 is connected with an electric wire (not shown).

According to the above descriptions, there is a specific distance d existing between the open end 37 of the casing 31 and the first retaining piece 311 and the second retaining piece 312 in the connector 3 of the present invention, and the conductive terminal 34 can be protected by the first retaining piece 311 and the second retaining terminal piece 312. Therefore, when a test finger enters the open end 37 for the safety test, the connector 3 can definitely conform to the electrical safety requirement due to the specific distance d. Moreover, the opening 313 formed by the first retaining piece 311 and the second retaining piece 312 is apparently smaller than the open end 37 of the casing 31, so that the connector 3 can further conform to the electrical safety requirement. Therefore, the connector 3 of the present invention is much safer than the conventional connector. In addition, when the connector 3 is connected with another one, the connection between the two connectors can be firmer since the contact area between the casings of the two connectors is increased.

Figure 4A:
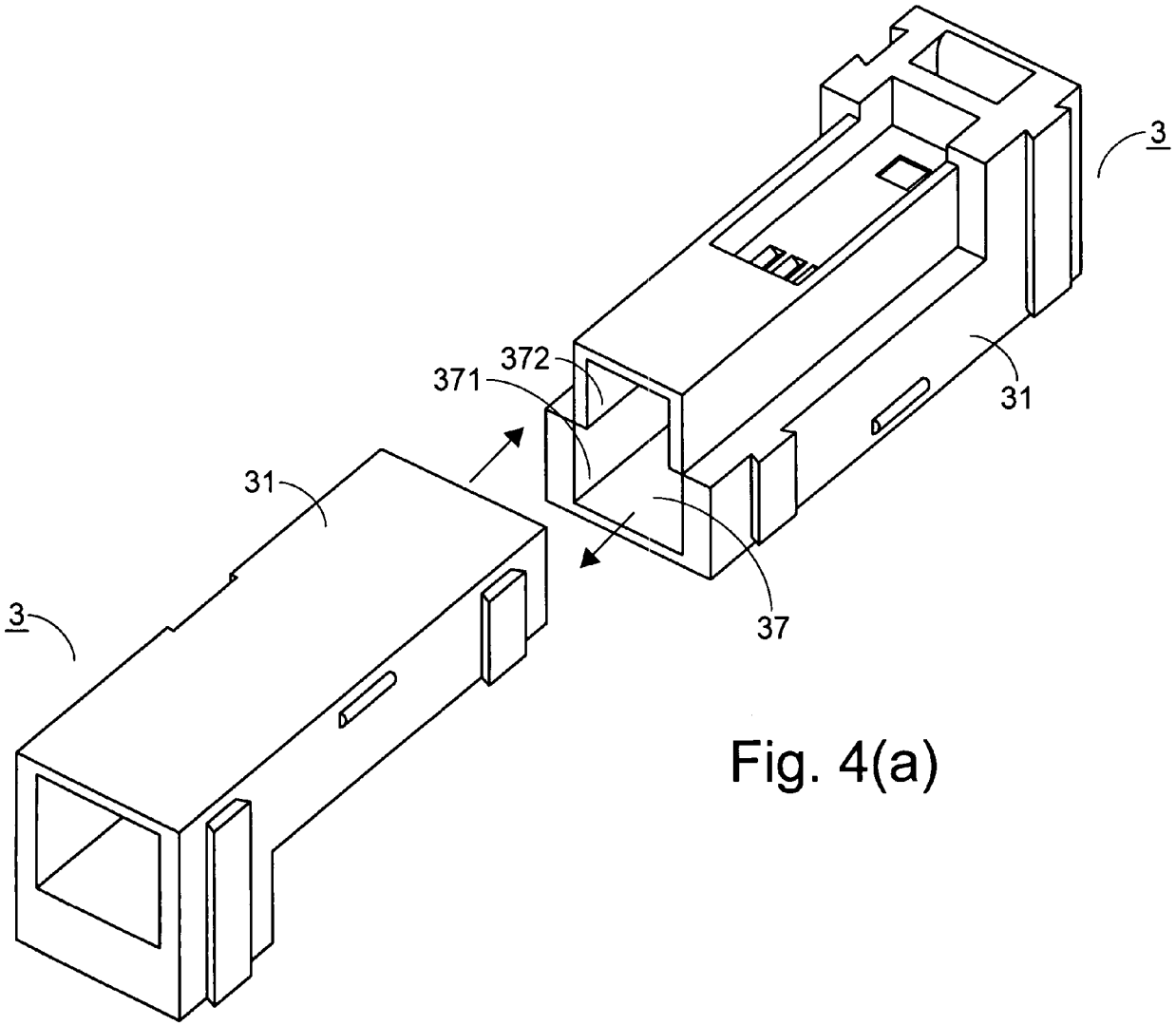
FIGS. 4(*a*) and (*b*) show schematic diagrams of two connectors in FIG. 3 before and after connection.
Figure 4B:
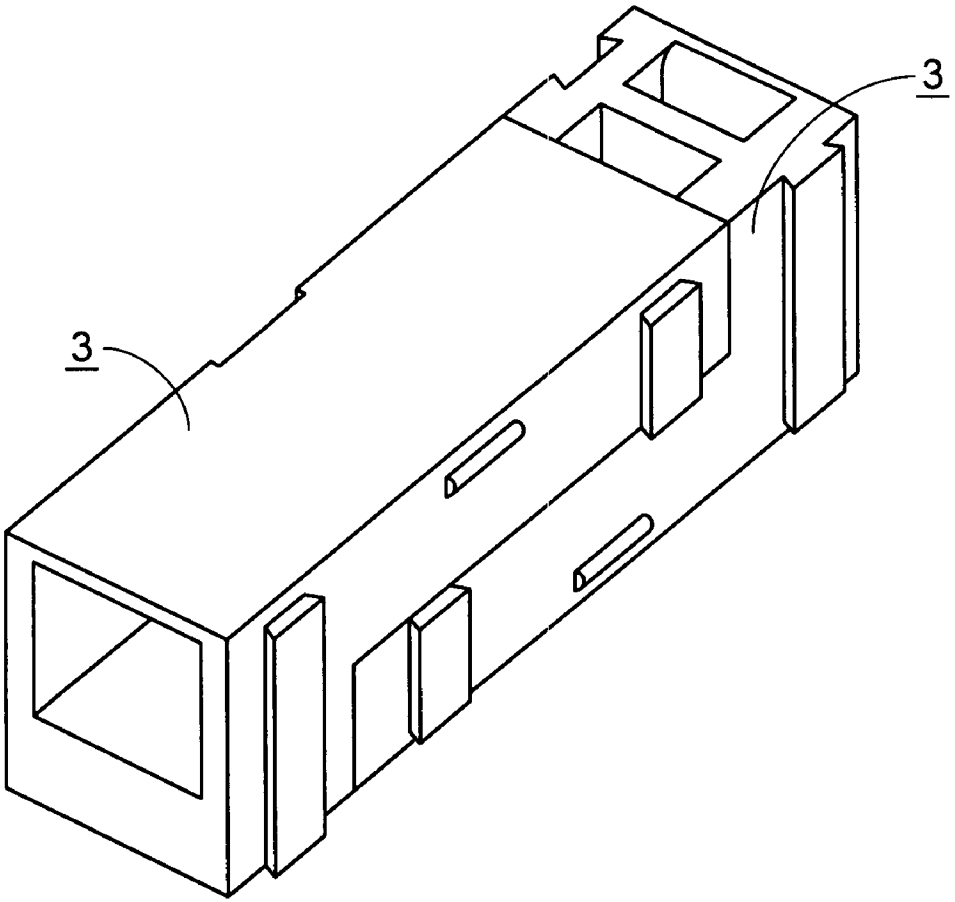

Please refer to FIGS. 4(*a*) and (*b*), which show schematic diagrams of two connectors in FIG. 3 before and after connection. As shown in FIGS. 4(*a*) and (*b*), the two opposite connectors have identical size and shape, and their casings 31 are substantially rectangular solids. The two connectors are electrically connected by inserting the second cavity 372 of one of the two connectors into the first cavity 371 of the other one of the two connectors. Via the coordinating structures of the casings, the two connectors can be engaged with each other and thus connected firmly.

Figure 5:
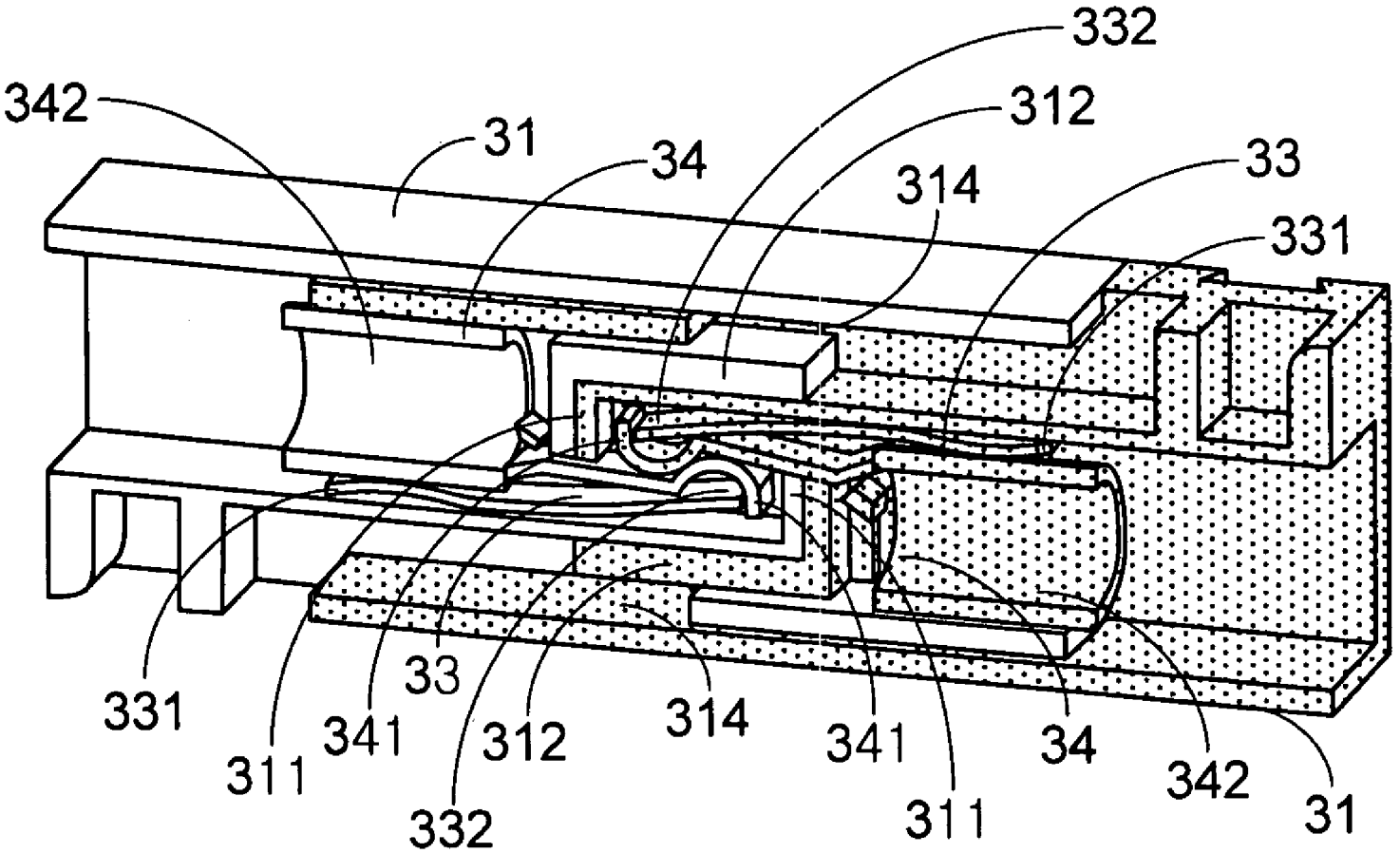
FIG. 5 shows a cross-sectional view of the connectors in FIG. 4(*b*)

Please refer to FIG. 5, which shows a cross-sectional view of the connectors in FIG. 4(*b*); for better illustration, one of the two connectors is dotted. As shown in FIG. 5, when the second cavity 372 of each connector 3 inserts into the first cavity 371 of the other connector 3, the first retaining piece 311 of each connector also inserts into the opening 313 of the other connector and is contacted with the second retaining piece 312 of the other connector; thereby the contact area between the two connectors is increased, so the connection therebetween is firmer. In addition, the end 341 of the conductive terminal 34 of each connector 3 is also inserted into the opening 313 of the other connector 3 and is contacted with the conductive terminal 34 of the other connector 3. Because one end 331 of the resilient piece 33 is fixed to or propped up the inner sidewall of the casing 31 and the other end 332 of the resilient piece 33 is contacted with the end 341 of the conductive terminal 34, the conductive terminals 34 of two connectors 3 can be connected tightly by the restoring force of the resilient pieces 33. Furthermore, when the two connectors 3 are connected with each other, the sidewall of the casing 31 of each connector 3 can be inserted into the gap 314 of the other connector 3. Therefore, the two connectors can be connected more firmly by increasing the contact area between the two connectors. Besides, with such connection structure, the creepage distance is longer so as to conform to the electrical safety requirement.

As the efficacy of the electrical equipment (such as a desktop computer and an industrial computer) is enhanced, the demand of power delivery between the power supply system (such as a battery, a power supply or an uninterrupted power supply system) and the electrical equipment is accordingly arisen. Because the electric power that can be delivered by a single connector is restricted and there is a need for ground connection, a connector assembly is further developed in the present invention. Moreover, to make the assembling and dissembling of the connectors between the electrical equipment and the power supply system easier, a connector assembly applied to various aspects is also provided by the present invention.

Figure 6A:
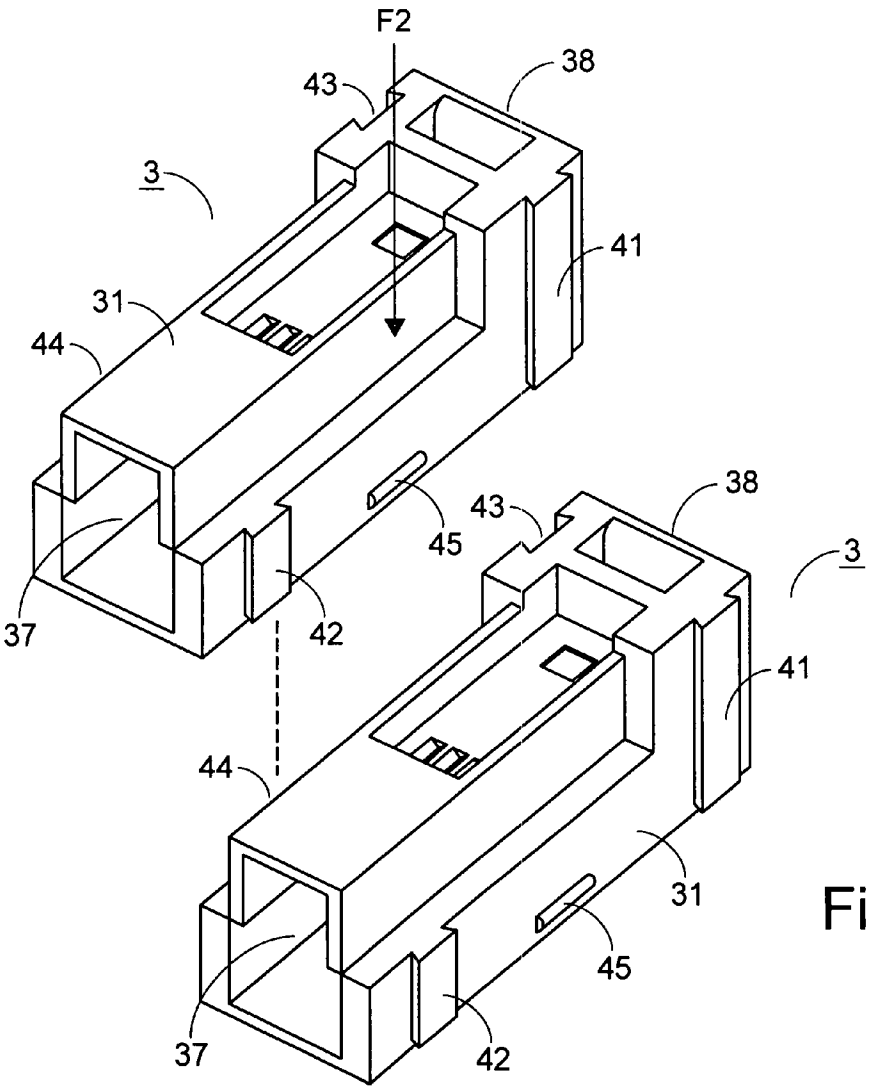
FIGS. 6(*a*) and (*b*) show schematic diagrams of a connector assembly of two connectors before and after assembling.
Figure 6B:
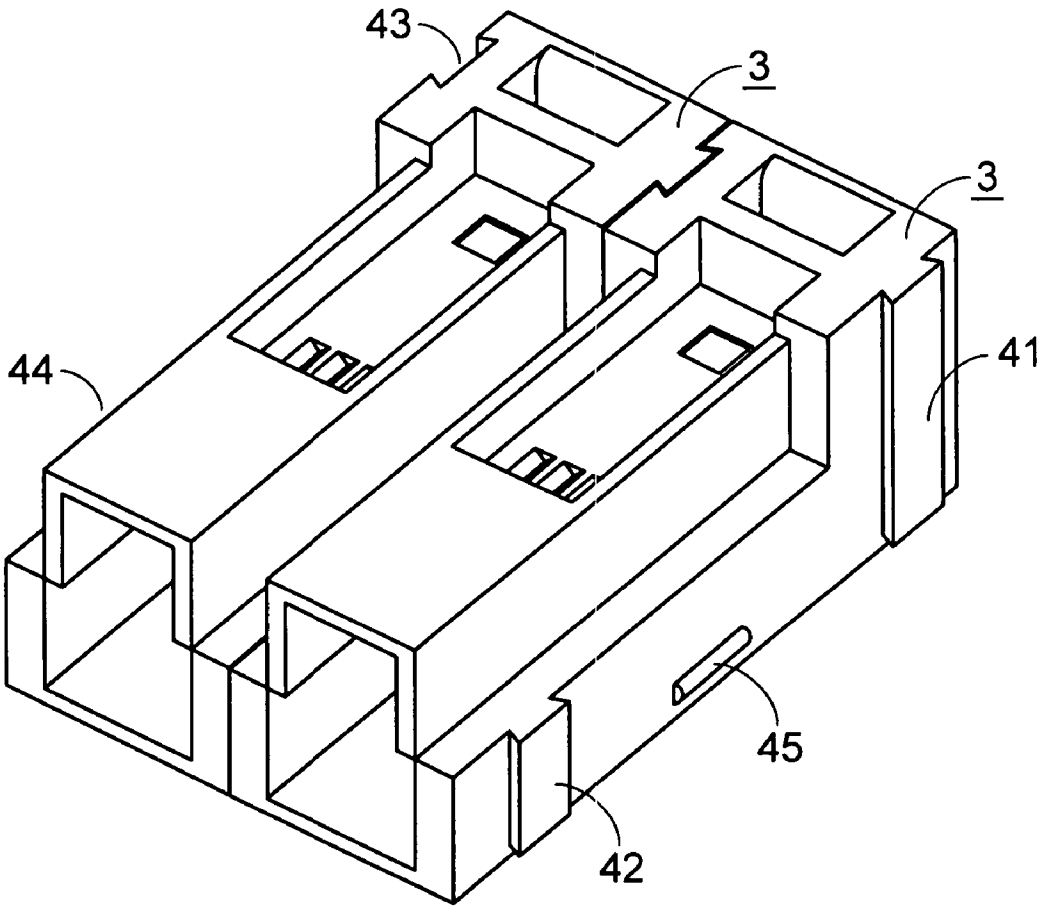

Please refer to FIGS. 6(*a*) and (*b*), which show schematic diagrams of a connector assembly of two connectors before and after assembling. As shown in FIG. 6(*a*), except the structures shown in FIG. 3, each connector 3 further comprises two protruding pillars 41 and 42 and two guide slots 43 and 44. The protruding pillars 41 and 42 are vertically arranged on one sidewall of the casing 31 and close to the open end 37 and the wire-exiting end 38 respectively. The guide slots 43 and 44 are vertically arranged on the opposite sidewall of the casing 31 and corresponding to the protruding pillars 41 and 42. Additionally, the connector 3 comprises two positioning elements respectively disposed on the two opposite sidewalls of the casing 31 and substantially located at the centers of the sidewalls. For example, one of the positioning elements disposed on one sidewall is a protrusion 45, and the other one of the positioning elements disposed on the opposite sidewall is a concave indentation (not shown).

Please refer to FIGS. 6(*a*) and (*b*) again. When assembling the two connectors into a connector assembly, the protruding pillars 41 and 42 on the casing 31 of one of the connectors are downwardly slid into the guide slots 43 and 44 on the casing 31 of the other connector 3 first, and then the two positioning elements, i.e. the protrusion 45 on the casing 31 of one of the connectors and the concave (not shown) on the casing of the other connector, are engaged with each other, so as to position the two connectors; the assembled structure is shown in FIG. 6(*b*). Although the present technique is illustrated by the connector assembly composed of two connectors 3 in this embodiment, it is to be understood that the present invention needs not to be limited to the disclosed embodiment; any suitable quantity of the connectors to be assembled into a connector assembly can be incorporated herein for reference.

According to the above descriptions, a plurality of connectors are assembled into a connector assembly by up and down engagement via the protruding pillars 41 and 42 and the guide slots 43 and 44. Therefore, when dissembling the connector assembly, the electric wire will not fall off easily. In addition, because the protruding pillars 41 and 42 and the guide slots 43 and 44 are arranged vertically on two opposite sidewalls of the casing 31, it is easy for the user to assemble and dissemble the connector assembly with small force F2.

Moreover, due to the design of the positioning elements for each connector 3, the plurality of connectors 3 can be positioned more accurately as assembled. Therefore, the connector of the present invention has the advantages of convenient and firm assembling and broad application.

Other applications of the connector and the connector assembly of the present invention are further described as follows.

Figure 7A:
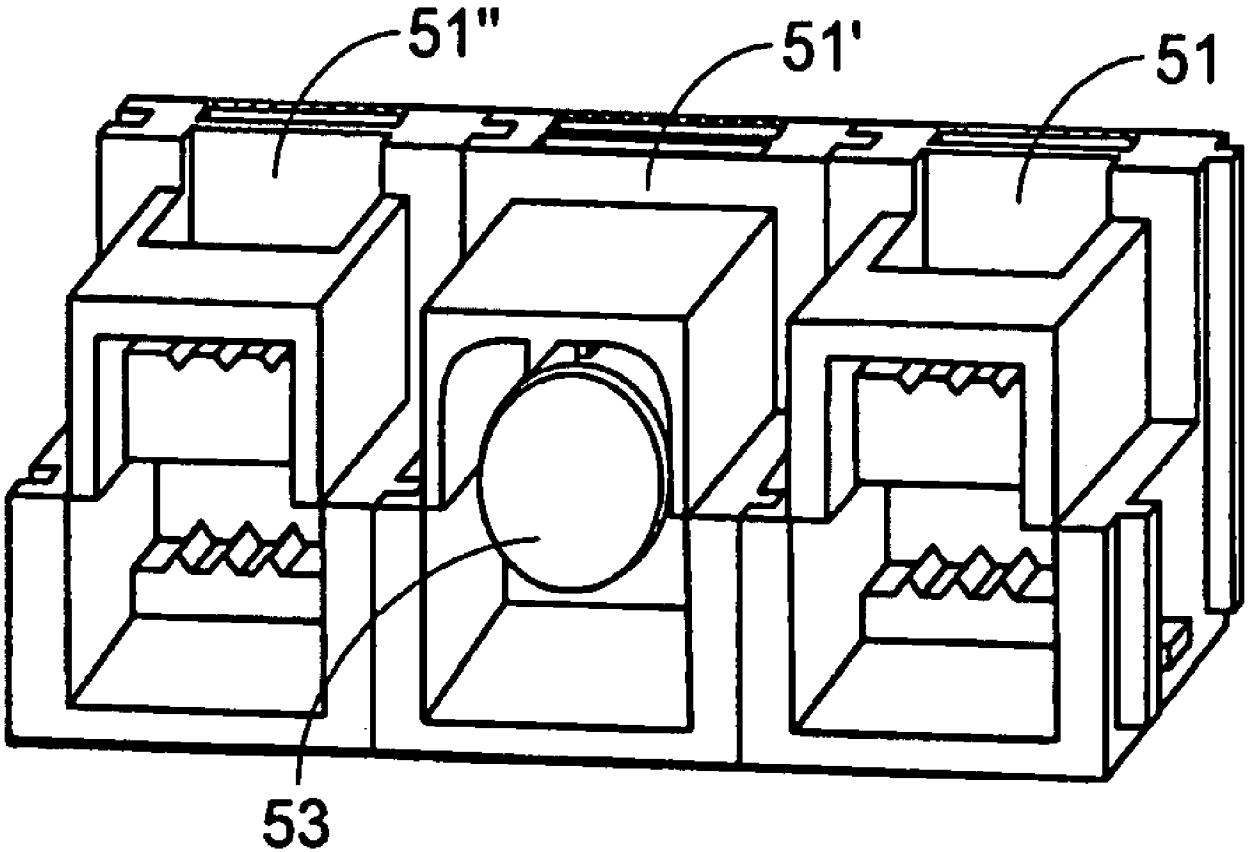
FIGS. 7(*a*) and (*b*) show the connector assembly applied to a plug.
Figure 7B:
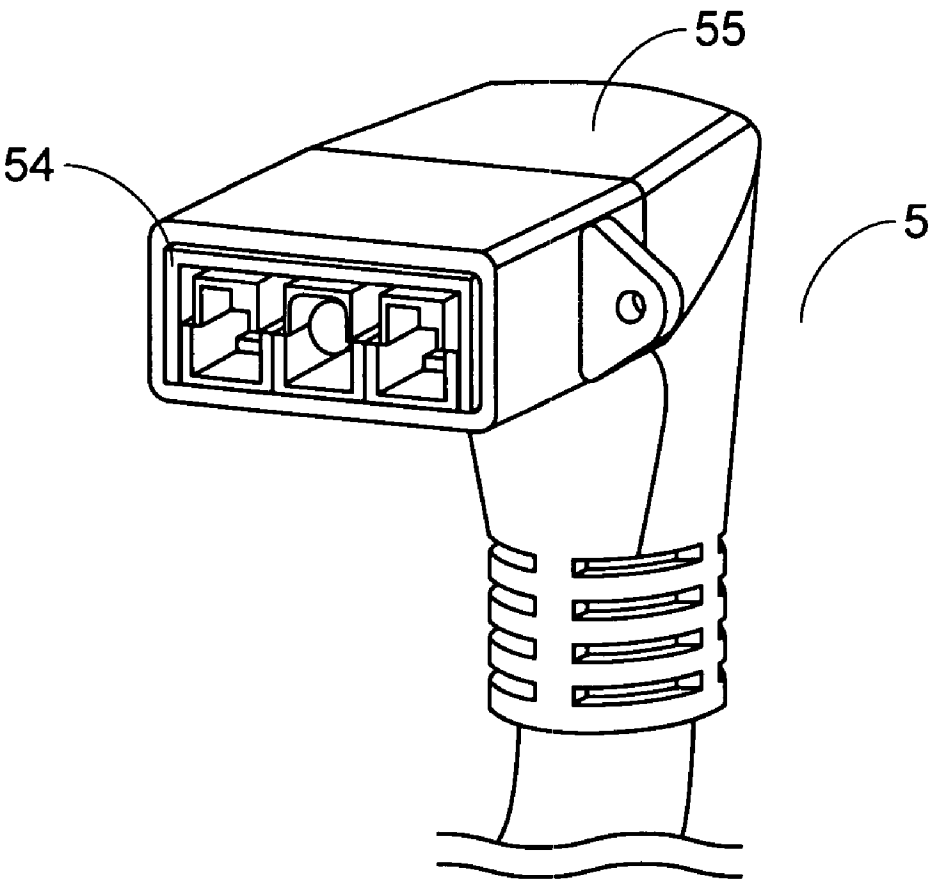

FIG. 7(*a*) shows the connector assembly applied to a plug. For example, the plug can be composed of a connector assembly comprising three connectors 51, 51' and 51". In this embodiment, two connectors 51 and 51" are identical with the above-mentioned connector 3. The other connector 51' is for ground connection and substantially identical with the above-mentioned connector 3 in structure. The only difference is that the conductive terminal of the connector 51' is substituted by a column-shaped conductive terminal 53. Certainly, except the connector assembly composed of three connectors 51, 51' and 51" and the electric wire, the connector assembly can be further covered by a piece 54 and then be plasticized with a cover 55 to form an electric wire 5 with plug as shown in FIG. 7(*b*). Certainly, the position of the connector 51' for ground connection is not restricted, but it is preferably located in the center.

Figure 8A:
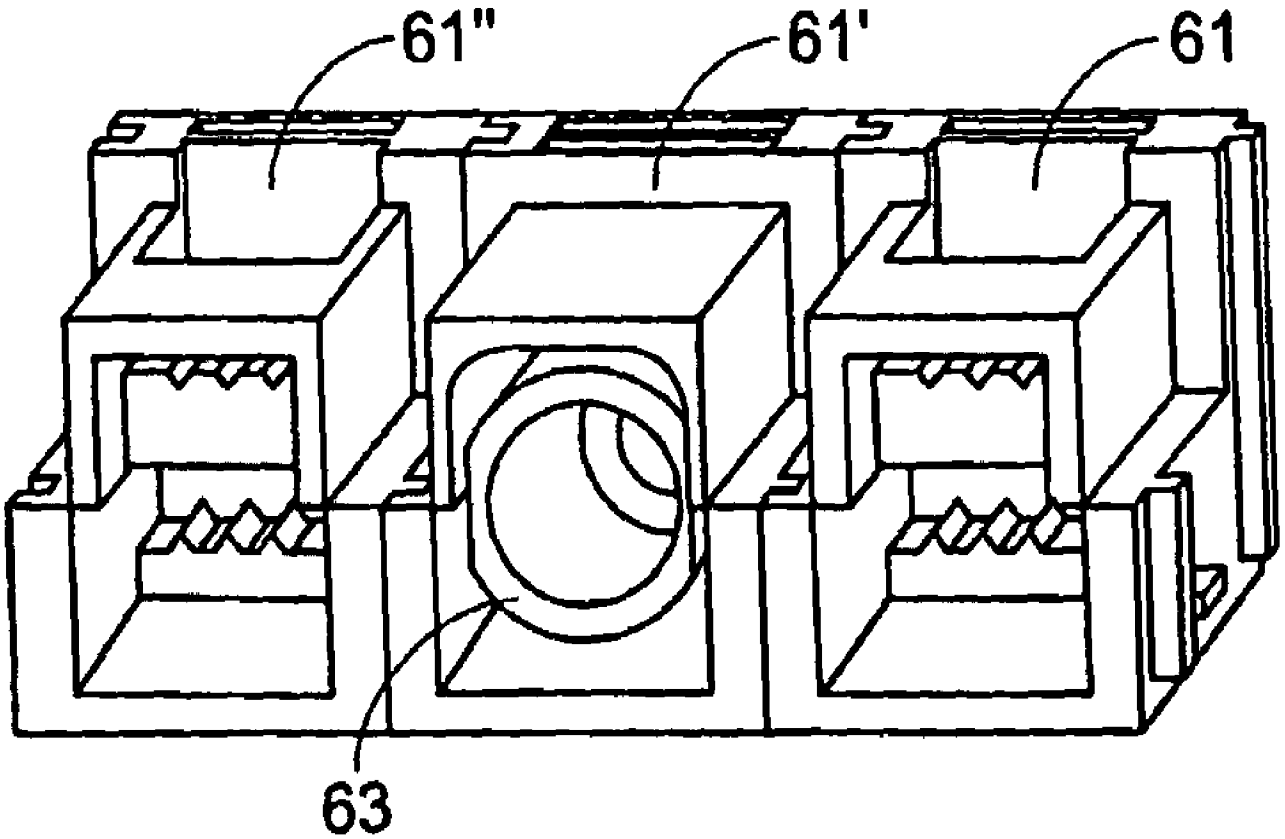
FIGS. 8(*a*) and (*b*) show the connector assembly applied to a socket.
Figure 8B:
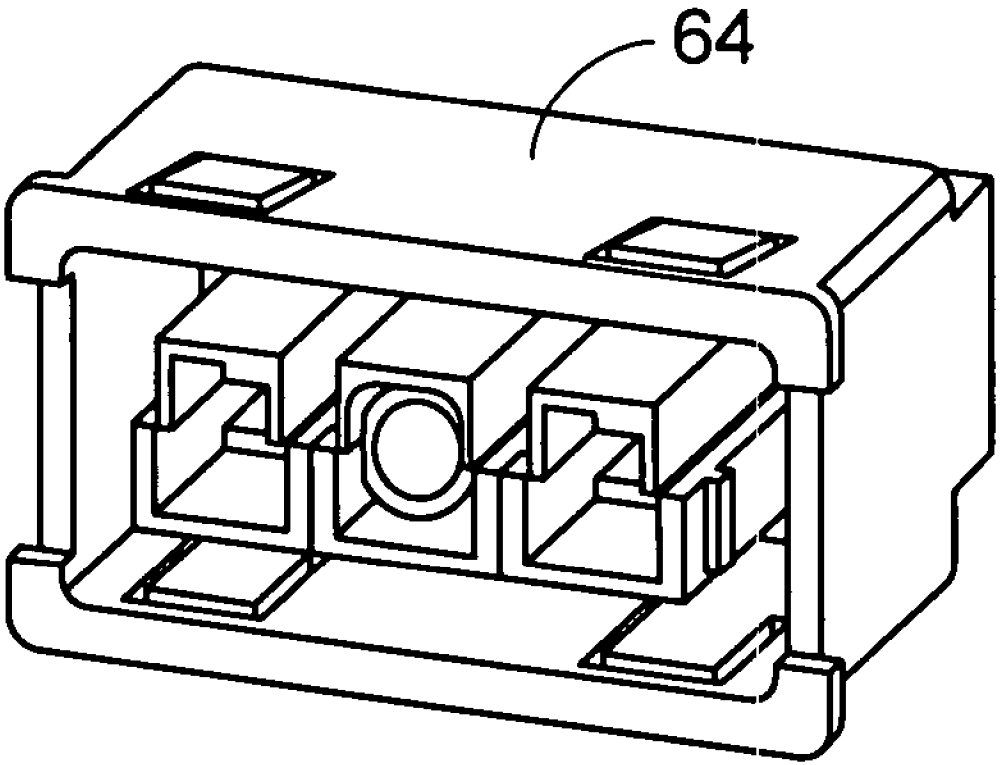

Except the plug, the connector assembly can also be applied to a socket. Please refer to FIG. 8(*a*), which shows the connector assembly applied to a socket. For example, the socket can be composed of a connector assembly comprising three connectors 61, 61' and 61", wherein two connectors 61 and 61" are identical with the above-mentioned connector 3. The other connector 61' is for ground connection and substantially identical with the above-mentioned connector 3 in structure. The only difference is that the conductive terminal of the connector 61' is substituted by a cylinder-shaped conductive terminal 53. Certainly, except the connector assembly composed of three connectors 61, 61' and 61" and the electric wire, the connector assembly can be further plasticized with a cover or covered by a casing 64 to form a socket 6, as shown in FIG. 8(*b*). The socket 6 can be disposed in the receiving space of a casing of an electrical equipment or a power supply system to be served as the socket of the electrical equipment or the power supply system. Certainly, the position of the connector 61' is not restricted, but it is preferably located in the center.

Figure 9A:
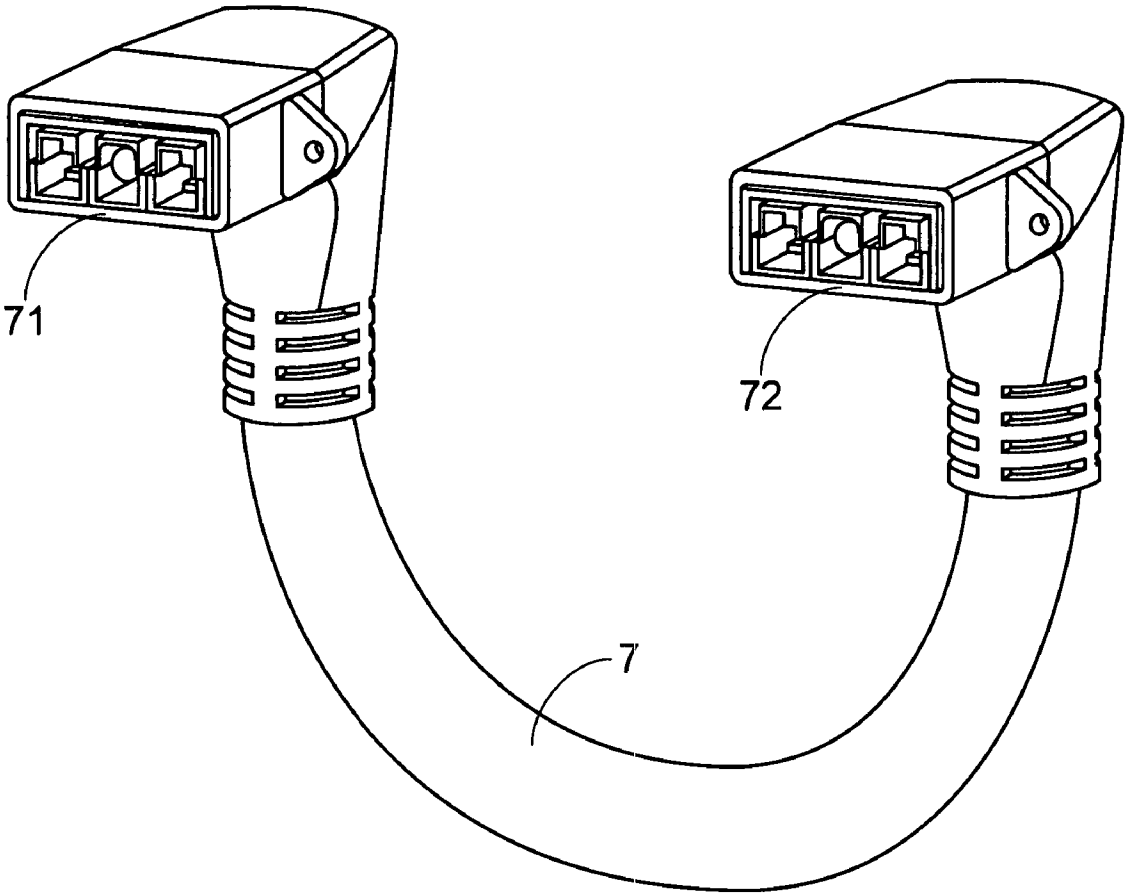
FIGS. 9(*a*) and (*b*) show the connector assembly applied to connect an electrical equipment and a power supply system.
Figure 9B:
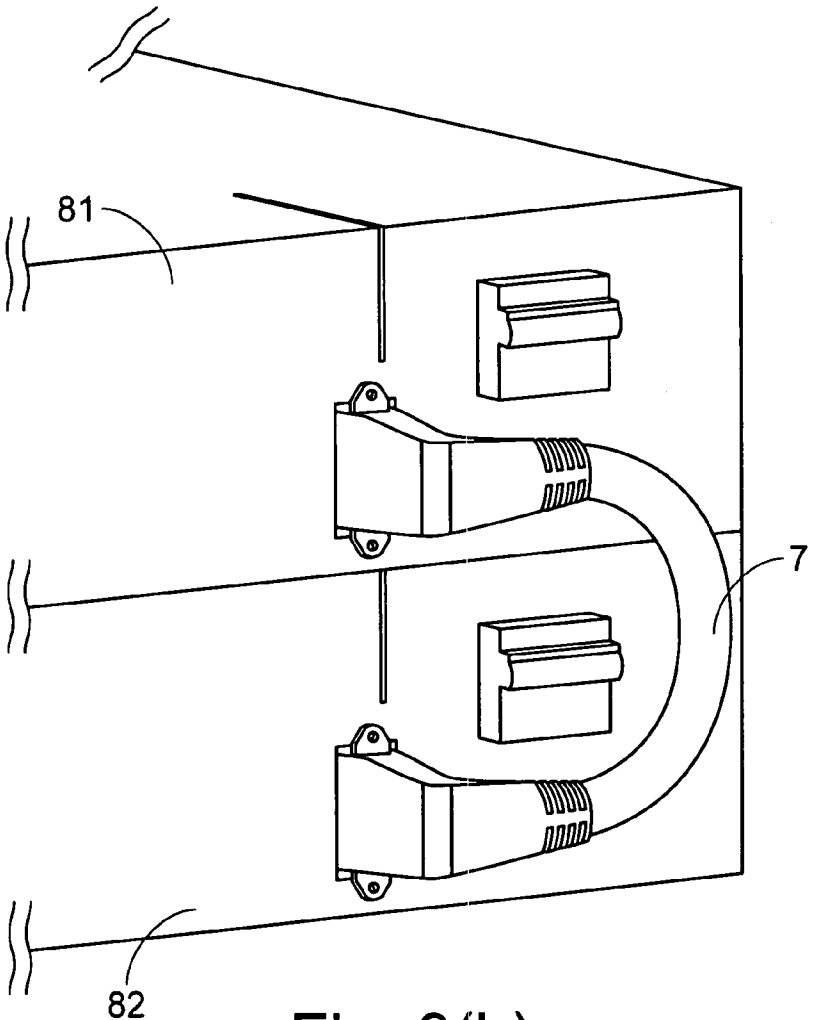
Figure 10:
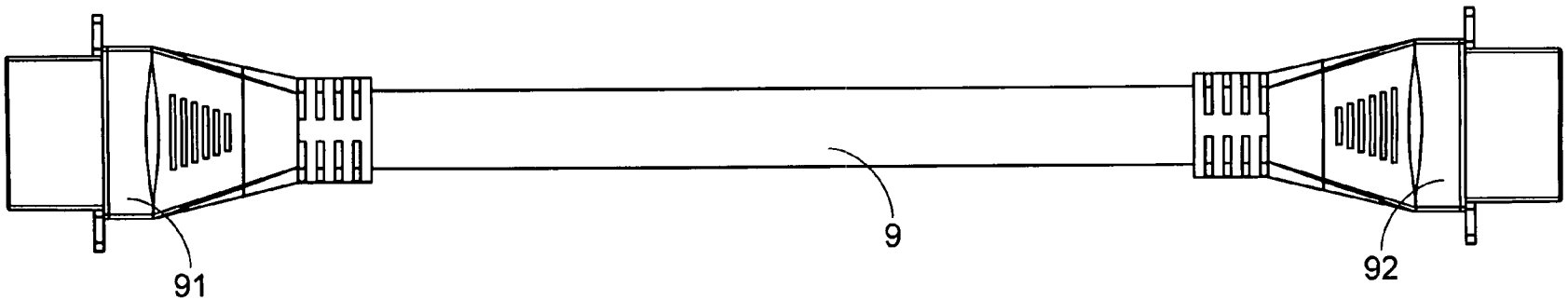
FIG. 10 shows the connector assembly applied to another electric wire.

Additionally, as shown in FIGS. 9(*a*) and (*b*), the plugs 71 and 72 shown in FIG. 7(*b*) can be disposed on two ends of an electric wire 3, and the sockets shown in FIG. 8(*b*) can be respectively disposed on the casing 81 of an electrical equipment (such as an industrial computer) and on the casing 82 of a power supply system (such as an interrupted power supply system). Then the plugs 71 and 72 are respectively connected with the sockets (not shown) to electrically connect the electrical equipment with the power supply system. Certainly, the plugs 71 and 72 on the two ends of the electric wire 7 can have an angle of about 90 degrees relative to the electric wire as shown in FIG. 9, or the electric wire 9 can have an angle of about 180 degrees relative to the sockets 91 and 92 as shown in FIG. 10.

In conclusion, the present invention provides a connector, which can surely conform to the electrical safety requirement via the design of the retaining piece and the specific open end and keeping a specific distance between the conductive terminal and the open end. Besides, two connectors can be connected with each other more rapidly and firmly, and the utilization safety can be enhanced by increasing the creepage distance because of the special design of the casing of the connector. Moreover, the design of the protruding pillar and the guide slot arranged vertically on the two opposite sidewalls of the casing is convenient for the user to form a connector assembly via the up and down engagement, and can prevent the electric wire of the connector assembly from falling off, so as to further improve the convenience of assembling. Further, the connector of the present invention can be applied to a variety of aspects like the plug and the socket.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector, comprising:

a casing having an open end defined by a first cavity and a second cavity adjacent to said first cavity, wherein a cross-section area of said first cavity is bigger than that of said second cavity, wherein a cross-section of said casing is substantially ⊔-shaped;

a first L-shaped retaining piece disposed in said first cavity and a second L-shaped retaining piece disposed in said second cavity and having a specific distance away from said open end, wherein said first retaining piece and said second retaining piece cooperate with each other to form an opening and a receiving space therebetween, said first retaining piece is disposed above said second retaining piece, and said first retaining piece and said second retaining piece respectively form gaps with an upper and a lower inner sidewalls of said casing; and a conductive terminal with one end disposed in said receiving space formed between said first retaining piece and said second retaining piece, wherein said casing carries a resilient piece therein, and one end of said resilient piece is fixed to or propped up from said lower inner sidewall of said casing and the other end of said resilient piece is contacted with one end of said conductive terminal.

2. The connector according to claim 1 wherein the other end of said conductive terminal is connected with an electric wire.

3. The connector according to claim 1 wherein said casing further comprises:

at least a protruding pillar vertically arranged on one sidewall of said casing; and at least a guide slot vertically arranged on the opposite sidewall of said casing and corresponding to said protruding pillar.

4. The connector according to claim 1 wherein said casing further comprises two positioning elements respectively disposed on two opposite sidewalls of said casing.

5. The connector according to claim 4 wherein said two positioning elements are a protrusion and a concave indentation respectively.

6. The connector according to claim 1 wherein said casing is substantially a rectangular solid and has a wire-exiting end.

7. A connection structure of connectors, comprising:

at least two connectors having identical size and shape, each of which comprises:

a casing having an open end defined by a first cavity and a second cavity adjacent to said first cavity, wherein a cross-section area of said first cavity is bigger than that of said second cavity, wherein a cross-section of said casing is substantially ⊔-shape;

a first L-shaped retaining piece disposed in said first cavity and a second L-shaped retaining piece disposed in said second cavity and having a specific distance away from said open end, wherein said first retaining piece and said second retaining piece cooperate with each other to form an opening and a receiving space therebetween, said first retaining piece is disposed above said second retaining piece, and said first retaining piece and said second retaining piece respectively form gaps with an upper and a lower inner sidewalls of said casing; and a conductive terminal with one end disposed in said receiving space formed between said first retaining piece and said second retaining piece, wherein said casing carries a resilient piece therein, and one end of said resilient piece is fixed to or propped up from said lower inner sidewall of said casing and the other end of said resilient piece is contacted with one end of said conductive terminal;

thereby said two connectors are connected with each other by inserting said second cavity of each connector into said first cavity of the other connector to make said conductive terminals in said casings of said two connectors contact with each other.

8. The connection structure of connectors according to claim 7 wherein the other end of said conductive terminal is connected with an electric wire.

9. A connector assembly, comprising:

a plurality of connectors, each of which comprises:

a casing having an open end, wherein a cross-section of said casing is substantially ⊔-shaped;

a first L-shaped retaining piece disposed in a first cavity and a second L-shaped retaining piece disposed in a second cavity and having a specific distance away from said open end, wherein said first retaining piece and said second retaining piece cooperate with each other to form an opening and a receiving space therebetween, said first retaining piece is disposed above said second retaining piece, and said first retaining piece and said second retaining piece respectively form gaps with an upper and a lower inner sidewalls of said casing; and a conductive terminal with one end disposed in said casing;

at least a protruding pillar vertically arranged on one sidewall of said casing; and at least a guide slot vertically arranged on the opposite sidewall of said casing and corresponding to said protruding pillar;

thereby said plurality of connectors are assembled into a connector assembly by up and down engagement via said protruding pillar on one connector and said guide slot on another connector.

10. The connector assembly according to claim 9 wherein said open end is defined by a first cavity and a second cavity adjacent to said first cavity, and a cross-section area of said first cavity is bigger than that of said second cavity.

11. The connector assembly according to claim 9 wherein said casing further comprises two positioning elements respectively disposed on two opposite sidewalls of said casing.

12. The connector assembly according to claim 11 wherein said two positioning elements are a protrusion and a concave indentation respectively.

13. The connector assembly according to claim 9 wherein said casing carries a resilient piece therein, and one end of said resilient piece is fixed to or propped up said lower inner sidewall of said casing and the other end of said resilient piece is contacted with one end of said conductive terminal.

14. The connector according to claim 9 wherein the other end of said conductive terminal is connected with an electric wire.

15. The connector assembly according to claim 9 wherein said casing is substantially a rectangular solid and has a wire-exiting end.

* * * * *